US008327545B2

(12) United States Patent
Peterson

(10) Patent No.: US 8,327,545 B2
(45) Date of Patent: Dec. 11, 2012

(54) RAZOR CARTRIDGES WITH PERFORATED BLADE ASSEMBLIES

(75) Inventor: Mark Peterson, Reading (GB)

(73) Assignee: The Gillette Company, Boston, MA (US)

( * ) Notice: Subject to any disclaimer, the term of this patent is extended or adjusted under 35 U.S.C. 154(b) by 324 days.

(21) Appl. No.: 12/568,747

(22) Filed: Sep. 29, 2009

(65) Prior Publication Data

US 2010/0077618 A1 Apr. 1, 2010

Related U.S. Application Data

(60) Provisional application No. 61/101,048, filed on Sep. 29, 2008.

(51) Int. Cl.
*B26B 21/22* (2006.01)

(52) U.S. Cl. ..... 30/50; 30/41; 30/346.61

(58) Field of Classification Search ..... 30/41, 41.5, 30/50, 346, 346.5, 346.61, 351
See application file for complete search history.

(56) References Cited

U.S. PATENT DOCUMENTS

| | | | | | |
|---|---|---|---|---|---|
| 2,674,039 | A | | 4/1954 | De Mesquita | |
| 2,705,365 | A | * | 4/1955 | Van Heest | 30/41 |
| 2,705,834 | A | | 4/1955 | Lundy | |
| 3,786,563 | A | * | 1/1974 | Dorion et al. | 30/50 |
| 3,861,040 | A | * | 1/1975 | Dorion, Jr. | 30/50 |
| 3,863,340 | A | | 2/1975 | Perry | |
| 3,938,250 | A | | 2/1976 | Perry | |
| 4,146,958 | A | | 4/1979 | Chen et al. | |
| 4,200,976 | A | * | 5/1980 | Gooding | 30/50 |
| 4,251,914 | A | * | 2/1981 | Grosjean | 30/84 |
| 4,270,268 | A | | 6/1981 | Jacobson | |
| 4,302,876 | A | | 12/1981 | Emmett | |
| 4,389,773 | A | | 6/1983 | Nissen et al. | |
| 4,407,067 | A | | 10/1983 | Trotta | |
| 4,586,255 | A | | 5/1986 | Jacobson | |
| 4,640,012 | A | * | 2/1987 | Thomas | 30/41 |
| 4,774,765 | A | * | 10/1988 | Ferraro | 30/50 |
| 4,932,122 | A | | 6/1990 | Shurland et al. | |
| 5,010,646 | A | | 4/1991 | Neamtu | |
| 5,018,274 | A | | 5/1991 | Trotta | |
| 5,060,377 | A | | 10/1991 | Althaus et al. | |
| 5,199,173 | A | | 4/1993 | Hegemann et al. | |
| 5,224,267 | A | | 7/1993 | Simms et al. | |
| 5,313,706 | A | * | 5/1994 | Motta et al. | 30/50 |
| 5,369,885 | A | * | 12/1994 | Ferraro | 30/41 |
| 5,551,153 | A | * | 9/1996 | Simms | 30/41 |

(Continued)

FOREIGN PATENT DOCUMENTS

GB 2 055 069 A 2/1981

(Continued)

*Primary Examiner* — Jason Daniel Prone
(74) *Attorney, Agent, or Firm* — Kevin C. Johnson; Steven W. Miller

(57) ABSTRACT

A razor cartridge comprising a housing, a guard disposed toward a front portion of the housing, a cap disposed toward a rear portion of the housing, a plurality of bent blade assemblies, wherein at least one of the blade assemblies comprises one or more perforations along a length of the assembly. In another embodiment, a razor cartridge comprising a housing, a guard disposed toward a front portion of the housing, a cap disposed toward a rear portion of the housing, a plurality of integrally formed bent blade assemblies, wherein each of the blade assemblies comprises one or more perforations along a length of the assembly.

8 Claims, 6 Drawing Sheets

U.S. PATENT DOCUMENTS

| | | | | |
|---|---|---|---|---|
| 5,671,534 | A * | 9/1997 | Mayerovitch | 30/41 |
| 5,715,606 | A * | 2/1998 | de Wolf et al. | 30/346.61 |
| 6,032,372 | A * | 3/2000 | Dischler | 30/50 |
| 6,035,535 | A * | 3/2000 | Dischler | 30/50 |
| 6,212,777 | B1 | 4/2001 | Gilder et al. | |
| 6,276,061 | B1 * | 8/2001 | Rozenkranc | 30/346.5 |
| 6,397,473 | B1 * | 6/2002 | Clark | 30/50 |
| 6,430,818 | B1 | 8/2002 | Wonderley | |
| 6,473,970 | B1 | 11/2002 | Prochaska | |
| 6,655,030 | B2 | 12/2003 | Zuidervaart | |
| 7,100,284 | B2 | 9/2006 | King | |
| 7,131,202 | B2 | 11/2006 | Pennell et al. | |
| 7,272,991 | B2 * | 9/2007 | Aviza et al. | 30/50 |
| 7,730,619 | B2 * | 6/2010 | Ozenick | 30/50 |
| 8,225,510 | B2 * | 7/2012 | Peterson et al. | 30/50 |
| 2001/0029669 | A1 * | 10/2001 | Ferraro et al. | 30/50 |
| 2002/0144404 | A1 | 10/2002 | Gilder et al. | |
| 2003/0182802 | A1 * | 10/2003 | Vega et al. | 30/50 |
| 2003/0204955 | A1 | 11/2003 | Gilder et al. | |
| 2004/0118250 | A1 | 6/2004 | White et al. | |
| 2005/0015991 | A1 | 1/2005 | Follo et al. | |
| 2005/0108882 | A1 | 5/2005 | Gilder et al. | |
| 2005/0198837 | A1 | 9/2005 | Rawle | |
| 2007/0124939 | A1 | 6/2007 | Van Eibergen Santhagens | |
| 2008/0022530 | A1 | 1/2008 | Royle | |
| 2009/0188112 | A1 * | 7/2009 | Prochaska et al. | 30/50 |
| 2009/0193659 | A1 | 8/2009 | Park et al. | |
| 2010/0077617 | A1 * | 4/2010 | Peterson et al. | 30/50 |
| 2011/0162208 | A1 * | 7/2011 | Wain | 30/50 |
| 2011/0162209 | A1 * | 7/2011 | Wain | 30/50 |

FOREIGN PATENT DOCUMENTS

| | | | |
|---|---|---|---|
| JP | 04361782 | A * | 12/1992 |
| JP | 04361783 | A * | 12/1992 |
| WO | WO 95/04637 | | 2/1995 |

* cited by examiner

RAZOR CARTRIDGES WITH PERFORATED BLADE ASSEMBLIES

CROSS REFERENCE TO RELATED APPLICATIONS

This application claims the benefit of U.S. Provisional Application No. 61/101,048 filed Sep. 29, 2008.

FIELD OF THE INVENTION

This invention relates to a razor cartridge suitable for use in a wet shaving razor wherein said cartridge comprises bent blade assemblies with perforations or openings.

BACKGROUND OF THE INVENTION

Wet shaving razors have evolved over the years to include a multiplicity of blades with the goal of increasing the closeness of the shave that is achieved while also still providing a comfortable shaving experience. In particular, the blades include sharp cutting edges that engage the hair during cutting so as to extend the hair from the skin. After the hair is extended, it does not immediately retract into the skin. A second blade may further cut the hair before it fully retracts, so-called "hysteresis cutting," resulting in a closer shave. Safety razors with multiple blades may provide multiple cutting and extending events and multiple opportunities for hysteresis cutting.

The distance between consecutive cutting edges or so-called "span" is theorized to affect the shaving process in several ways. The span between cutting edges may control the degree to which skin will bulge between blades, with smaller spans resulting in less skin bulge and more skin comfort during shaving, but may also increase opportunities for double engagement. Larger spans may reduce opportunities for double engagements but may result in more skin bulge between cutting edges and less skin comfort. The span between cutting edges and, thus between blades, may affect rinsing of shave preparations and shave debris after a shaving stroke, with larger spans easing or quickening rinsing and smaller spans slowing or making rinsing more difficult.

A need therefore exists to provide wet shaving razor cartridges having an increased number of blades within a cartridge that does not retain debris but still provides an effective and pleasant shaving experience to a consumer.

SUMMARY OF THE INVENTION

The present invention relates to a razor cartridge comprising a housing, a guard disposed toward a front portion of the housing, a cap disposed toward a rear portion of the housing, a plurality of bent blade assemblies, wherein at least one of the blade assemblies comprises one or more perforations along a length of the assembly.

In another embodiment, the present invention relates to a razor cartridge comprising a housing, a guard disposed toward a front portion of the housing, a cap disposed toward a rear portion of the housing, a plurality of integrally formed bent blade assemblies, wherein each of the blade assemblies comprises one or more perforations along a length of the assembly.

DETAILED DESCRIPTION OF THE INVENTION

Figure 1:
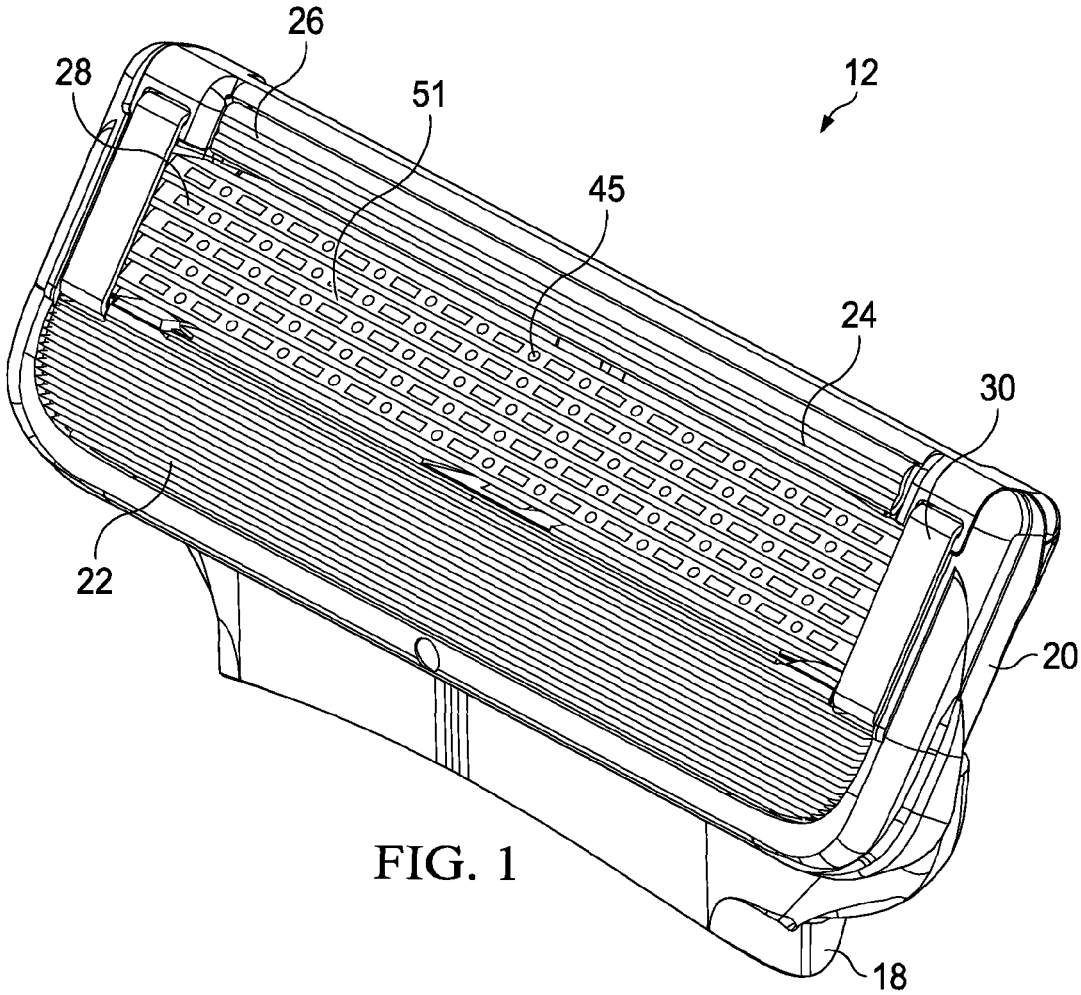
FIG. 1 shows a right perspective view of a razor cartridge of the present invention having five bent blade assemblies.

Referring to FIG. 1, a razor cartridge 12 according to the present invention is shown. This embodiment optionally includes a connector 18 that may be removably attached to handle (not shown) and pivotally connects to the cartridge 12 on an underside of a housing 20. The guard 22 is disposed at the front of housing 20. This guard may comprise projections of varying shapes, e.g., fins, chevrons, tubes, etc. A cap 24, which includes a lubricating strip 26, is disposed at the rear of housing 20. Clips 30 retain a plurality of bent blade assemblies 28 within the housing 20 between guard 22 and cap 24. In other embodiments, two, three, four, or any suitable number of blade assemblies may be used. At least one of these blade assemblies further comprises composite perforations 51 and, optionally, joined weld areas 45. As used herein "openings" and "perforations" may be used interchangeably and refer to an aperture in an assembly material.

Figure 2:
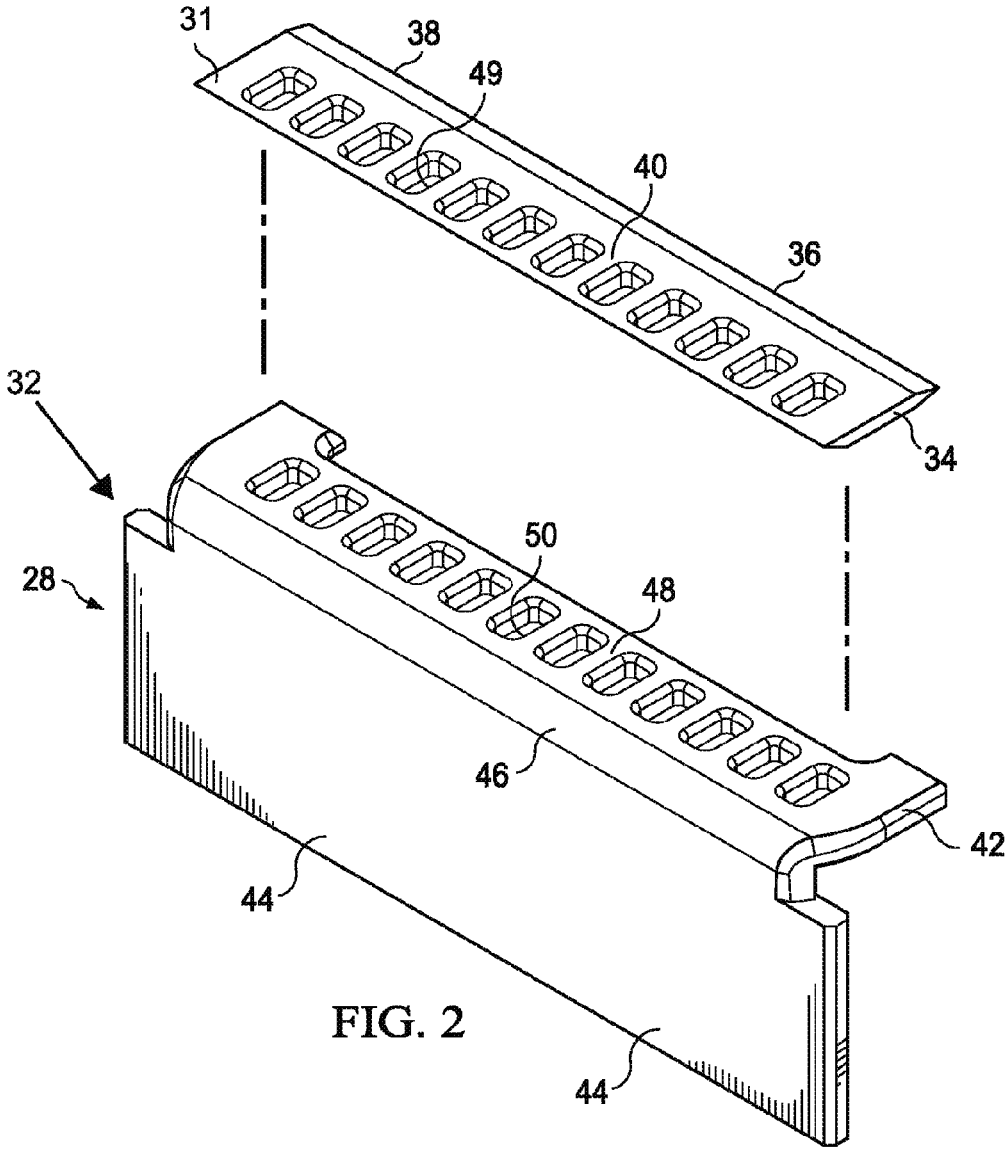
FIG. 2 shows an exploded isometric view of a bent blade assembly of the razor cartridge of FIG. 1.

A bent blade assembly 28 is shown in FIG. 2. This blade assembly 28 includes an elongated blade 31 and an elongated support 32. Blade 31 has an elongated body portion 34 and a tapered portion 36 narrowing to a sharpened cutting edge 38. Body portion 34 has blade weld areas 40 spaced along its length for laser welding blade 31 to support 32. Other methods of joining the body to the support may be used, such as mechanical fasteners or adhesives.

Support 32 has an elongated platform portion 42 joined to an elongated, downwardly extending base portion 44 by an elongated bent portion 46. Support weld areas 48 are spaced along the length of platform portion 42 for attachment of blade body as described above.

Between blade weld areas 40 and support weld areas 48, body portion 34 has perforations 49 and platform portion 42 has perforations 50 that are aligned one over the other such that a composite perforation 51 is formed. Composite perforations 51 permit liquid (e.g., water, shave preparation, etc.) to flow through the plurality of blade assemblies 28 for improved rinsing of shave preparation from the cartridge. Composite openings 51 may also reduce any contact area of blades 30 with skin and/or hair thus also reducing the opportunity to push an extended hair back into the skin and increasing hysteresis cutting opportunities. The size of composite openings 51 are limited by the size of weld areas 40 necessary to maintain weld integrity and the rigidity of blade assembly 28 necessary to resist unwanted flexing during shaving. Any size, number, and configuration of composite perforations may be used so long as the integrity of the blade assembly is maintained.

Perforations 49, 50, 51 may be formed via stamp cutting, laser cutting, punching, or any similar method known to skilled artisans. In most instances, the perforations 49, 50, 51 will be formed after the blade 30 is attached to support 32.

Figure 3:
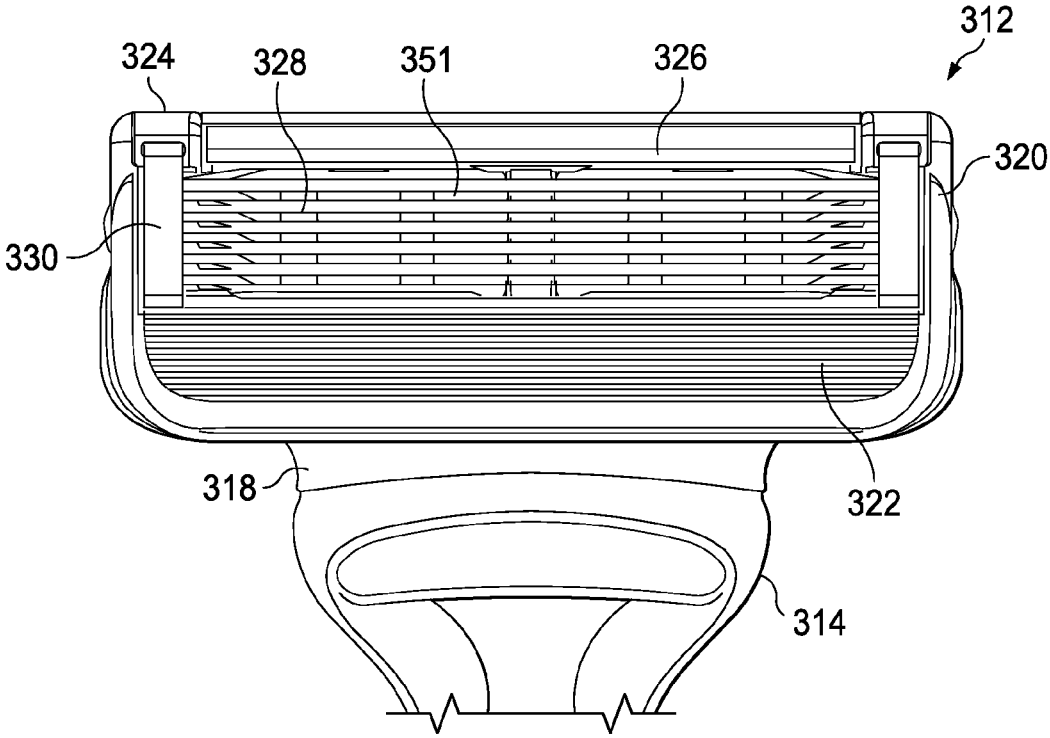
FIG. 3 shows a front elevational view of another razor cartridge of the present invention having five bent blade assemblies.

Another embodiment of a razor cartridge 312 of the present invention is shown in FIG. 3. This embodiment optionally includes a connector 318 that may be removably attached to handle 314 and pivotally connects to the cartridge 312. The guard 322 is disposed at the front of housing 320. A cap 324, which includes a lubricating strip 326, is disposed at the rear of housing 320. Clips 330 retain a plurality of bent blade assemblies 328 within the housing 320 between guard 322 and cap 324. In other embodiments, two, three, four, or any suitable number of bent blade assemblies may be used. These blade assemblies further comprise perforations 351.

Figure 4A:
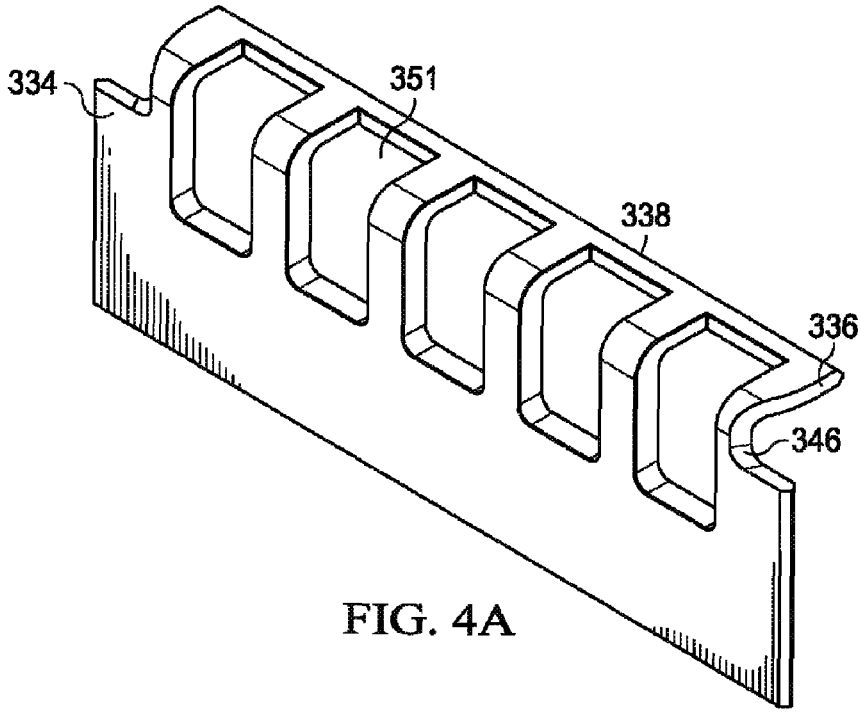
FIG. 4A shows a left perspective view of a bent blade assembly suitable for inclusion in the razor cartridge of FIG. 3.
Figure 4B:
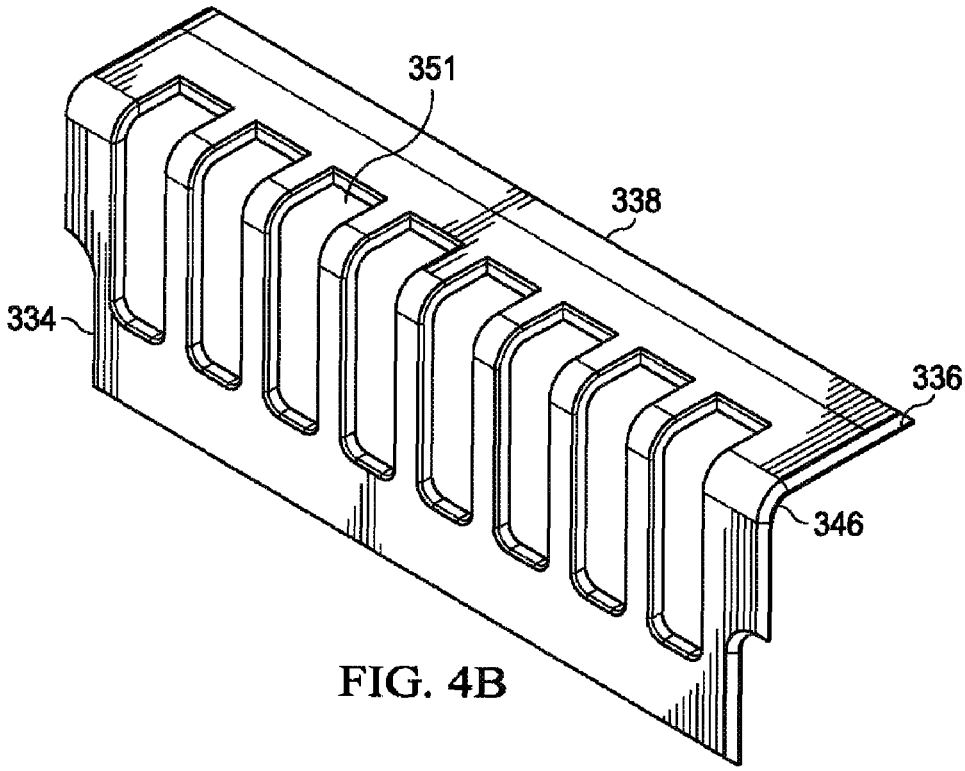
FIG. 4B shows a left perspective view of an alternate bent blade assembly suitable for inclusion in the razor cartridge of FIG. 3.

A suitable blade assembly 328 is shown in FIGS. 4A and 4B. These blade assemblies are manufactured differently than the blade assembly of FIG. 2. In these instances, the assembly 328 is integrally formed from a single piece of material that is bent. In most instances, the material is selected from the group of materials consisting of stainless steel, aluminum, ceramic, glass, plastic, and combinations thereof. The material may be bent using any suitable means known for the particular material being bent. The blade assembly 328 has an elongated body portion 334 along one lengthwise side, a tapered portion 336, along an opposing lengthwise side, narrowing to a sharpened cutting edge 338, and a bent portion 346 disposed between the body portion 334 and the tapered portion 336. The perforations 351 may span one or more portions of the blade assembly. For instance, the perforation may be contained within the tapered portion 336, the bent portion 346, and/or the elongated body portion 334. FIGS. 4A and 4B each show the perforation 351 spanning all three portions. It is important to note, however, that blade assembly 328 must be rigid enough to resist unwanted flexing during shaving, which limits the size and configuration of perforations 351. These perforations 351 may be formed via laser cutting, stamp cutting, stamping, etc.

Figure 5:
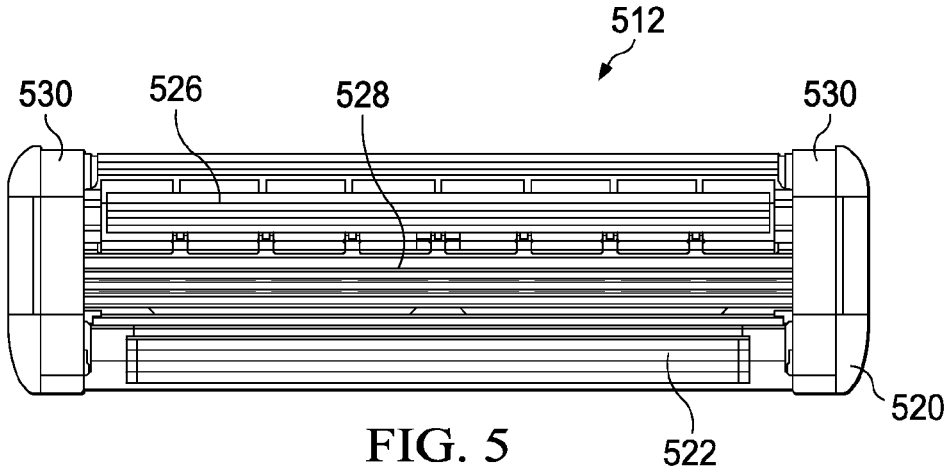
FIG. 5 shows a front elevational view of another embodiment of a razor cartridge per the present invention having four bent blade assemblies.

Another embodiment of a razor cartridge of the present invention is shown in FIG. 5. This razor cartridge 512 has a smaller footprint than the one shown in FIG. 1. In other words, the housing 520 has a smaller area than the housing 20 of FIG. 1. Moreover, the guard 522 is smaller than the guard 22 of FIG. 1. This cartridge 512 comprises four elongated blade assemblies 528 disposed within the housing 520 between the guard 522 and the cap 524, which also includes a lubricating strip 526. The blade assemblies 528 are integrally formed as described above.

Figure 6:
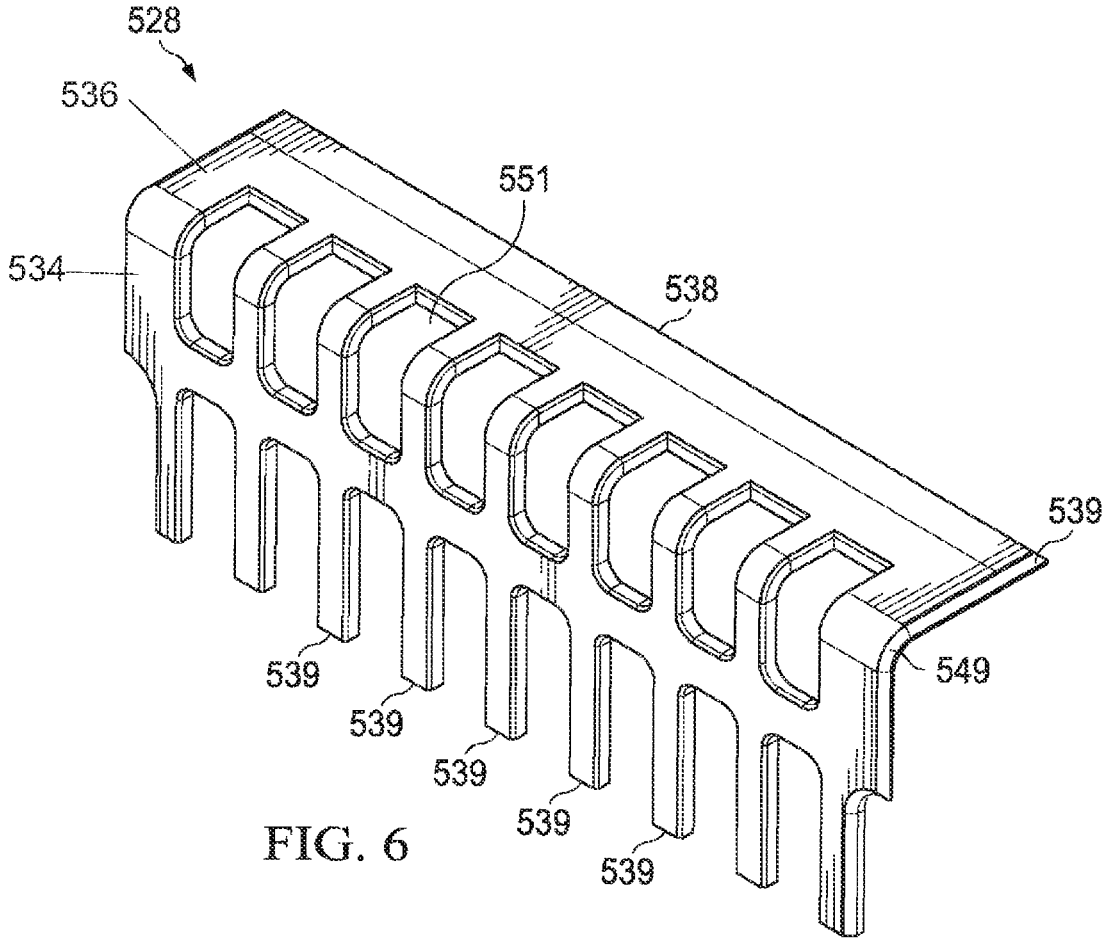
FIG. 6 shows a left perspective view of a fingered bent blade assembly suitable for inclusion in the razor cartridge of FIG. 5.

FIG. 6 demonstrates a blade assembly 528 that differs from the integrally formed versions depicted in FIGS. 4A and 4B. Here, this assembly 528 includes an elongated body portion 534 along one lengthwise side, a tapered portion 536, along an opposing lengthwise side, narrowing to a sharpened cutting edge 538, and a bent portion 549 disposed between the body portion 534 and the tapered portion 536. The perforations 551 may span one or more portions of the blade assembly. For instance, the perforation may be contained within the tapered portion 536, the bent portion 546, and/or the elongated body portion 534. FIG. 6 shows the perforation 551 spanning all three portions. In this embodiment, unlike the previous ones, there are one or more support fingers 539 that extend from the body portion 534 along its length. These fingers 539 are disposed within the housing to provide structural integrity of the blade assemblies within the cartridge.

Figure 7:
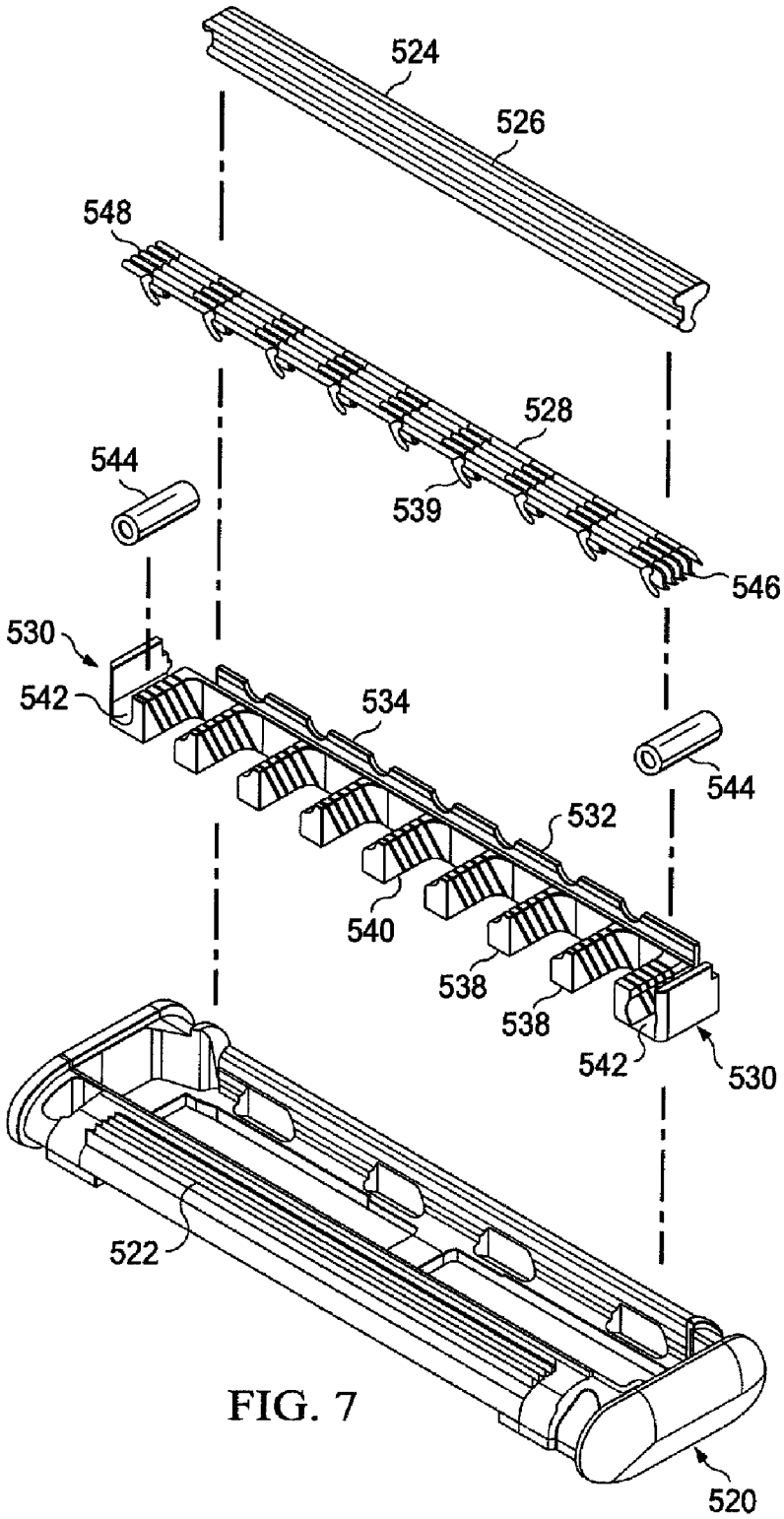
FIG. 7 shows an exploded perspective detail view of the razor cartridge of FIG. 5.

FIG. 7 shows an exploded perspective view of the cartridge of FIG. 5. Here, one can view one or more block support members 530 that provide support for each blade assembly 528 against shaving forces that could cause blade assembly 528 to bend undesirably. Block support member 530 has a rearwardly disposed wall portion 532 extending along the width of housing 520. Wall portion 532 may form a channel 535 for receiving the cap 524. Forwardly extending from wall portion 532 are a series of support leg portions 537, each portion 537 corresponding to a location of a support finger 539 along the length of a blade assembly 528. Each leg portion 537 forms a series of support slots 540 for receiving a support finger 539. In some instances slots simply fix the blade assemblies 528 so that they do not deflect under shaving forces, while in other instances, the slots guide the blade assemblies 528 as they move through a specific range of motion. In this instance, block support members 530 form channels 542 sized to accommodate flexible cylinders 544 that support ends 546, 548 of blade assemblies 528 and resist movement in the direction of slots 540.

Moreover, it has been found that utilization of such bent blade assemblies comprising such perforations facilitates rinsing of debris from the cartridge even in the presence of tightened blade spans as discloses in copending and co-filed U.S. patent application Ser. No. 12/568,743, entitled "Razors and Razor Cartridges with a Decreased Total Interblade Span".

The wet shaving razor cartridges of the present invention may be mounted permanently on a handle with the intention that the entire razor should be discarded when the blade assembly cutting edges have become dulled. Alternatively, the wet shaving cartridges of the present invention may be detachably mounted to a handle so that the cartridge may be replaced on the handle when the blade assemblies have lost the sharpness required for efficient shaving. In typical cartridges, the blade assemblies are usually carried by the housing, which is generally a molded plastic frame, and the blade assemblies may then be supported to move within the frame, either independently of each other or in unison under forces imparted on the blade assemblies by the skin during shaving. In one embodiment of support within the housing, the blade assemblies are mounted fixedly within slots in a blade retaining member like the block support member mentioned above. In most instances, there will be one or more rigid blade retaining members disposed along a length of the housing to provide adequate and immovable support for the blade assemblies disposed therein. In another instance, the blade assemblies may be floatably mounted within the housing. Here, the plurality of blade assemblies is supported by one or more spring loaded blade retaining members where such blade assemblies are permitted to respond to the forces encountered during shaving. The housing comprises a guard at a forward portion. The guard contacts a shaver's skin immediately ahead of the plurality of blade assemblies. The cap is disposed after the plurality of blade assemblies within the housing and toward a rear portion. The cap contacts the skin directly behind the plurality of blade assemblies during a shaving stroke. In the case of both the guard and the cap, each may comprise additional elements that are also joined to or integral to the housing.

In each embodiment of the invention, the level of comfort obtained with any given wet shaving razor cartridge is influenced strongly by the shaving geometry, which is the relative positioning of the skin contacting components. Important parameters of the shaving geometry include the blade exposure which is the distance by which the tip of the blade edge projects above, or is retracted below, a plane which is tangential to the skin contacting parts next in front and next behind the blade edge, the blade tangent angle (also known as the blade shaving angle) which is the angle at which the plane of the blade is inclined to a plane which is tangential to the guard and the cap surfaces (the tangent plane), and the blade span which is the distance by which the blade edge is spaced from the skin contacting element immediately in front of the blade edge, as seen in a plane which is tangential to the blade edge and the skin contacting element in front of it. A progressive blade exposure may be used in the present invention as detailed in U.S. Pat. No. 6,212,777.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor cartridge comprising:

a. a housing;

b. a guard disposed toward a front portion of the housing;

c. a cap disposed toward a rear portion of the housing;

d. at least one blade assembly comprising an elongated blade joined to an L-shaped elongated support, wherein the elongated blade comprises one or more perforations along a length of the elongated blade, wherein the L-shaped elongated support comprises another one or more perforations along a length of the L-shaped elongate support, and wherein the one or more perforations in the elongated blade are aligned with the one or more perforations in the elongated support to form one or more composite perforations along a length of the at least one bent blade assembly such that the one or more composite perforations are configured to permit liquid to flow through the one or more composite perforations for rinsing.

2. The razor cartridge of claim 1 wherein the elongated blade further comprises weld areas and the L-shaped elongated support further comprises weld areas and wherein the elongated blade and the L-shaped elongated support are joined to one another at their respective weld areas.

3. The razor cartridge of claim 1 wherein said cartridge comprises a connector that may be removably attached to a handle and is pivotally connected to the housing.

4. A razor cartridge comprising:

a. a housing;

b. a guard disposed toward a front portion of the housing;

c. a cap disposed toward a rear portion of the housing;

d. a plurality of integrally formed bent blade assemblies, wherein each of the bent blade assemblies comprises one or more perforations along a length of each of the bent blade assemblies, wherein the each of the bent blade assemblies comprises a tapered portion, a bent portion, and a body portion, the one or more perforations span the tapered portion, the bent portion, and the body portion and wherein a plurality of spaced apart support fingers are disposed along the length of each of the bent blade assemblies and the support fingers extend from the body portion and wherein the housing comprises a block support members for support provision of each of the bent blade assemblies, the block support members comprises a rearwardly disposed wall portion extending along a width of the housing and a series of support leg portions extending forwardly from the wall portion, each of the support leg portions corresponding to a location of one of the support fingers.

5. The razor cartridge of claim 4 wherein each of the support leg portions define a slot for receiving one of the support fingers.

6. The razor cartridge of claim 4 wherein the block support member has a channel.

7. The razor cartridge of claim 6 further comprising a flexible cylinder that supports an end of one of the bent blade assemblies, wherein the channel accommodates the flexible cylinder.

8. The razor cartridge of claim 4 wherein said cartridge further comprises a connector that may be removably attached to a handle and is pivotally connected to the housing.

* * * * *